US005349836A

United States Patent [19]

Lee, Jr.

[11] Patent Number: 5,349,836

[45] Date of Patent: Sep. 27, 1994

[54] METHOD AND APPARATUS FOR MINIMIZING PLUG DIAMETER VARIATION IN SPIN FLOW NECKING PROCESS

[75] Inventor: Harry W. Lee, Jr., Chesterfield County, Va.

[73] Assignee: Reynolds Metals Company, Richmond, Va.

[21] Appl. No.: 953,421

[22] Filed: Sep. 29, 1992

Related U.S. Application Data

[63] Continuation-in-part of Ser. No. 929,933, Aug. 14, 1992, Pat. No. 5,245,848.

[51] Int. Cl.[5] ..... B21D 19/12

[52] U.S. Cl. ..... 72/84; 72/105

[58] Field of Search ..... 72/84, 105, 106, 110

[56] References Cited

U.S. PATENT DOCUMENTS

| | | | |
|---|---|---|---|
| 1,356,980 | 10/1920 | Gray . | |
| 3,227,070 | 1/1966 | Brigham et al. . | |
| 3,266,451 | 8/1966 | Kraus . | |
| 3,283,551 | 11/1966 | Kraft et al. . | |
| 3,469,428 | 9/1969 | Aschberger . | |
| 3,613,571 | 10/1971 | Russell et al. . | |
| 3,688,538 | 9/1972 | Hoyne | 72/94 |
| 3,754,424 | 8/1973 | Costanzo | 72/105 |
| 4,023,250 | 5/1977 | Sproul et al. | 72/83 |
| 4,058,998 | 11/1977 | Franek et al. | 72/84 |
| 4,070,888 | 1/1978 | Gombas | 72/91 |
| 4,170,888 | 10/1979 | Golata | 72/82 |
| 4,341,103 | 7/1982 | Escallon et al. | 72/70 |
| 4,391,511 | 7/1983 | Akiyama et al. . | |
| 4,606,207 | 8/1986 | Slade | 72/96 |
| 4,760,725 | 8/1988 | Halasz | 72/105 |
| 4,838,064 | 6/1989 | Pass | 72/84 |
| 4,870,847 | 10/1989 | Kitt | 72/84 |
| 5,228,321 | 7/1993 | Shibasaka | 72/84 |

*Primary Examiner*—Lowell A. Larson
*Attorney, Agent, or Firm*—Robert C. Lyne, Jr.

[57] ABSTRACT

A method and apparatus for spin flow necking-in a D&I can is disclosed wherein an externally located free spinning form roll is moved radially inward and axially against the outside wall of the open end of a trimmed can. A spring loaded interior support slide roll moves under the forming force of the form roll as the latter slides along a conical forming surface of a second free roll mounted axially inwardly adjacent the slide roll. To minimize the plug diameter variation between successively necked cans, the axial retracting movement of the slide roll is halted at a predetermined location via contact with a spacer to prevent further radial inward movement of the form roll which would otherwise occur as a result of only cam controlled form roll movement.

12 Claims, 16 Drawing Sheets

METHOD AND APPARATUS FOR MINIMIZING PLUG DIAMETER VARIATION IN SPIN FLOW NECKING PROCESS

RELATED APPLICATIONS

The present application is a continuation-in-part of application Ser. No. 07/929,933, filed Aug. 14, 1992, assigned to Reynolds Metals Company, Richmond, Va., the assignee of the present invention, now U.S. Pat. No. 5,245,848 granted Sep. 21, 1993.

TECHNICAL FIELD

The present invention relates generally to apparatus and methods for necking-in container bodies preferably in the form of a cylindrical one-piece metal can having an open end terminating in an outwardly directed peripheral flange merging with a circumferentially extending neck and, more particularly, to an improved spin flow necking process and apparatus for controlling the final movement of forming members to prevent unacceptable plug diameter variation.

BACKGROUND ART

Spin flow necking is a process of necking-in an open end of a metal container to provide a flange which allows a can end to be seamed thereto after filling. Necking also makes conveying of the cans easier since, with only slight flange overlap, the cans contact body-to-body instead of flange-to-flange which would otherwise cause tilting and conveying jams.

While numerous necking processes have been developed since the 1970's, a particularly promising spin flow process and apparatus having the potential of allowing can ends to be necked-in to increasingly smaller diameters is disclosed in U.S. Pat. No. 4,781,047, issued Nov. 1, 1988 to Bressan, which is assigned to Ball Corporation and is exclusively licensed to the assignee of the present invention, Reynolds Metals Company. The disclosure of this patent is hereby incorporated by reference herein in its entirety. It concerns a process where an externally located free spinning form roll 11 (FIG. 1) is moved inward and axially against the outside wall C′ of the open end C″ of a rotating trimmed can C to form a conical neck at the open end thereof- With reference to FIG. 1, a spring-loaded holder or slide roll 19 supports the interior wall of the can C and moves axially under the forming force of the free roll 11. This is a single operation where the can rotates and the free roll 11 rotates so that a smooth conical necked end is produced. In practice, the can is then flanged. The term "spin flow necking" is used in this application to refer to such processes and apparatus, the essential difference between spin flow necking and other types of spin necking being the axial movement of both the external roll 11 and the internal support 19.

More specifically, the spin flow tooling assembly 10 depicted in FIG. 1 (corresponding to FIG. 1 of the Bressan et al '047 patent, supra) includes a necking spindle shaft **16*a* rotatable about its axis of the rotation A by means of a spindle gear 16 mounted to the shaft between front and rear bearings (not shown). The slide roll 19 is mounted to the front end of the necking spindle shaft 16*a* through a slide mechanism 28, keyed to the shaft, which permits co-rotation of the roll 19 while allowing it to be slid by the necking forces described more fully below in the axially rearward direction B′ away from the eccentric freewheeling roll 24 located adjacent the front face of the slide roll. The axially fixed idler roll 24, having an axis of rotation B which is parallel to and rotatable about spindle axis A, is mounted via bearings 16*b* and 23 to an eccentrically formed front end of an eccentric roll support shaft 18. This shaft 18 extends through the necking spindle shaft 16*a*. The spindle shaft 16*a* is rotated by the spindle gear 16 without rotating the eccentric roll support shaft 18**.

The outer form roll 11 is mounted radially outwardly adjacent the slide and eccentric rolls 19,24.

The container slide roll 19 is shaped with a conical leading edge **19*a* designed to first engage the open end C″ of the container C to support same for rotation about spindle axis A under the driving action of the necking spindle gear 16 which may be driven by the same drive mechanism driving each base pad assembly 29 engaging the container bottom wall. Slide roll 19 is also free to slide axially but is resiliently biased into the container open end C″ via springs 20** which may be of the compression type.

In operation, the container open end C″ engages and is rotated by the slide roll 19. The eccentric roll 24 is then rotated into engagement with a part of the inside surface of the container side wall C′ located inwardly adjacent the open end C″. With reference to FIGS. 2A–2E, the external form roll 11 then begins to move radially inward into contact with the container side wall C′ spanning the gap respectively formed between the conical faces **19*a*,24*e* of the slide and eccentric rolls 19,24. More specifically, the side wall C′ of the spinning container body C is initially a straight cylindrical section of generally uniform diameter and thickness which may extend from a pre-neck (not shown) previously formed in the container side wall such as by static die necking. As the external form roll 11 engages the container side wall C′, it commences to penetrate the gap between the fixed internal eccentric roll 24 and the axially movable slide roll 19, forming a truncated cone (FIG. 2B). The side wall of the cone increases in length as does the height of the cone as the external form roll chamfer 11*c* continues to squeeze or press the container metal along the complemental slope or truncated cone 24*e* of the eccentric roll 24 as depicted in FIG. 2C. The cone continues to be generated as the external form roll 11 advances radially inwardly (the slide roll 19 continues to retract axially as a result of direct pushing contact from roll 11 through the metal) until a reduced diameter 124 is achieved as depicted in FIGS. 2C and 2D. As the cone is being formed, the necked-in portion 124 or throat of the container C conforms to the shape of the form portion of the forming roll 11. The rim portions 123 of the neck which extend radially outwardly from the necked-in portion 124 are being formed by the complemental tapers 11*b*,19*a* of the form roll 11 and the slide roll 19** to complete the necked-in portion.

The above-described spin flow necking process, while producing a large diameter reduction in the open end of the container C (e.g., 0.350″), has various drawbacks when applied to two-piece aluminum can manufacture. One drawback, for example, is grooving of the neck at the initial point of contact between rolls 11,19 in FIG. 2B which occurs on the inside of the container as a result of the small radii on the form roll pushing past and against the small radii on the slide roll as the form roll moves radially inwardly and axially rearwardly during the necking process along the chamfer **24*e* of the eccentric roll. Due to the force of spring 20 urging the slide roll 19 toward the eccentric roll 24, the metal caught between these colliding radii (which are forcefully pressed together under spring bias) is grooved on both the inner and outer surfaces of the neck. On the inside surface, this grooving results in metal exposure (i.e., wearing away of the protective coating) which often allows the beverage to "eat through" the container side wall C'. It has also been discovered that such grooving often results in actual cutting of the metal as the form roll 11** is radially inwardly advanced from the position depicted in FIG. 2B to that of FIG. 2C.

As the form roll 11 moves into its radially inwardmost position depicted in FIG. 2E, the spring pressure acting against the slide roll 19 in the direction of the form roll disadvantageously results in pinching of the end of the flange-like portion 123 and undesirable thinning of the metal. In some cases, particularly when necking a can to smaller diameters (e.g., 204 or 202), the edge is sometimes thinned down to a knife edge.

To prevent both grooving of the container side wall and excessive thinning of the flange type edge during the aforementioned spin flow necking process, a cam ring is secured to the slide roll to present a cam follower surface which is contacted by the form roll during radial inward advancing movement of the latter at the on-set of the necking-in process. The cam follower surface and the conical surface of the form roll facing the cam follower surface are further arranged to produce the following motions:

In FIG. 3A, the form roll axis has moved radially inwardly closer to the container axis and has started to form the neck. The conical surface **24*e* on the eccentric roll 24 has forced the form roll 11 toward the open end C" of the container C. The form roll 11 has just touched the cam follower surface 104. The small radius 106 on the form roll 11 is very close to the small radius 108 on the slide roll 19' but does not pinch the metal between these two points. This is because the cam ring follower surface 104 is positioned so these radii 106,108 may approach each other but stay separated by a distance slightly greater than the initial side wall thickness. This is presently understood to be a key feature in the elimination of metal exposure and neck cracks caused by excessive contact pressure between the two small radii 106,108 in the uncontrolled collision of the form roll 11 with the metal wrapped around the small radii 108 on the slide roll 19 in the prior spin flow necking process described hereinabove. In other words, since the form roll 11 contacts the cam follower surface 104 as the two radii 106,108 approach, such contact results in retraction or rearward axial sliding movement of the slide roll 19'** which permits the two radii to move past each other.

In FIG. 3B, the form roll 11 has penetrated further between the eccentric roll 24 and the slide roll 19'. The small radius 106 on the form roll 11 is just passing the small radius 108 on the slide roll 19'. The rolls 11,19' do not pinch the metal but have moved closer. As mentioned above, the form roll 11 is forcing the slide roll 19' back by contact between the form roll and the cam ring 102 instead of contact at this point between the form roll and the slide roll as occurred in the aforesaid prior spin flow necking process.

In FIG. 3C, the form roll 11 has continued its penetration and the small radius 106 is past the small radius 108 on the slide roll 19' (point A). At this point, the conical surfaces **19*a*,11*b* on the slide roll and the form roll, respectively, are opposite and parallel each other. The slide roll 19' and cam ring 102' have been pushed to the left in FIG. 3C. The combination of the metal thickening as a result of being squeezed between the form roll 11 and the eccentric roll 24 as the metal wraps around the forming surface 11*a* of the form roll, and the shape of the left or trailing conical surface 11*b*** on the form roll, has reduced the relative clearance between the form roll and the slide roll so that the form roll is now actually putting slight pressure on the metal.

In FIG. 3D, the form roll 11 has now penetrated further into the gap between the eccentric and slide rolls 24,19'. The form roll 11 is clearly clamping the metal between it and the slide roll 19' and, as a result, a gap 130 may open up between the form roll surface **11*b* and the cam ring follower surface 104. The form roll 11 is now pushing the slide roll 19' directly in the axially rearward direction through its contact with the metal, and not through the cam ring 102. Since the small radii 106,108 between the form roll 11 and slide roll 19' have already "slipped" past each other without undesirable grooving of the metal therebetween, the direct interaction of the form roll in thinning and shaping the metal against the bias of the conical surface 19*a*** on the slide roll is important to ensure proper necking and distribution of metal.

In FIG. 3E, the form roll 11 has now penetrated to its radially inwardmost position to complete the formation of the spin flow neck. During the entire forming process, between 20 to 24 revolutions of the container C are required, depending on the diameter, thickness and the amount of diameter reduction in the container end. The rolling contact between the form roll 11 and the slide roll 19' has thinned the edge of the flange slightly. Therefore, in accordance with a further feature of this invention, the form roll 11 now once again contacts the cam ring 102 to prevent further thinning of the flange area of the container C, i.e., gap 130 has closed.

The foregoing cam ring improvement to the spin flow necking process is disclosed in U.S. patent application Ser. No. 07/929,933, filed Aug. 14, 1992, by Harry W Lee, Jr. et al, which application is assigned to Reynolds Metals Company, the assignee of the present application. The disclosure of this application is hereby incorporated by reference herein in its entirety.

The cam ring advantageously eliminates the grooving and cut necks, as well as excessive thinning of the flange, that were prevalent before its introduction. However, the interaction of the outer form roll with the eccentric and slide rolls to achieve the final necked-in state depicted in either FIG. 2E (no cam ring) or FIG. 3E (with cam ring) has been discovered, through extensive experimentation, to directly affect the plug diameter (i.e., the inner diameter of the necked-in portion such as measured at 124 in FIG. 2E) and the length of flange 123, with or without the cam ring, and at any given base pad setting (i.e., the fixed distance during necking between the base pad 29 supporting the can bottom and the axially immovable eccentric roll), resulting in unacceptable variations therein. In a can plant environment, particularly when employing numerous necking-in tooling assemblies in a multi-station machine of the type disclosed in U.S. patent application Ser. No. 07/929,932, filed Aug. 14, 1992, by Harry W. Lee, Jr. et al, entitled "Spin Flow Necking Apparatus and Method of Handling Cans Therein", now U.S. Pat. No. 5,282,375 granted Feb. 1, 1994, assigned to Reynolds Metals Company, the present assignee, control over the plug diameter and flange width achieved with the tooling assembly at each station is critical to achieving homogeneity in product and successful continuous operation. The disclosure of the '932 application is hereby incorporated by reference herein in its entirety.

It is accordingly an object of the present invention to prevent unacceptable variations in can plug diameter and flange length during the spin flow necking process.

Another object is to control the interaction of the outer form roll with the inner slide roll to ensure such uniformity in plug diameters and acceptable plug diameter variation.

Yet another object is to control the aforesaid interaction between the outer form roll and the inner slide roll with the can by limiting the final movement of the inner slide roll and thereby the final movement of the outer form roll so that the final radially inward advancing movement of the latter is directly controlled by controlling the movement of the inner slide roll.

Yet another object is to provide a control mechanism that may be installed in each tooling assembly in the plant tool room so as to pre-set the movement of the inner slide roll to achieve the aforesaid uniformity in plug diameter, prior to installing the assemblies in a multi-station machine for continuous production of product.

Yet another object is to provide a plug diameter control mechanism which is simple in design, easy to install, and capable of rugged continuous operation without wear.

Disclosure of the Invention

An apparatus for necking-in an open end of a container body comprises a first member and a second member mounted for engaging the open end of the container side wall along an inner surface thereof. Means is provided for rotating the container body and externally located means moves radially inward into deforming contact with an outside surface of the container side wall in a region thereof overlying an interface between the first and second members. Such contact between the externally located means with the side wall causes the contacted wall portion to move radially inwardly into a gap formed at the interface, caused by axial separation of the first and second members under the action of the radially inward advancing movement of the externally located means into the gap to thereby neck-in the side wall. In accordance with the present invention, means is provided for limiting the final axial movement of the first member which in turn controls the final radially inwardmost location of the externally located means to ensure substantially uniform plug diameters in the necked-in cans.

In the preferred embodiment, the radial movement of the externally located means is cam controlled and the means for limiting its final radially inwardmost location overrides the radial movement otherwise provided through the camming surface.

In the preferred embodiment, the first member is a slide roll engaging and supporting the inside of the container open end. The slide roll is mounted for driven rotary motion about, and axial movement along, the container axis. The slide roll is resiliently biased into the container open end. The second member is an axially fixed roll mounted in axially inwardly spaced relation to the slide roll for engagement with an inside surface of the container side wall. The second roll has a conical end surface which faces the open end of the container and the slide roll includes a conical end surface facing the conical end surface of the axially fixed roll in opposite inclination thereto. The externally located means is a form roll having a peripheral deforming nose positioned externally of the container side wall and mounted for free rotary and controlled radial movement towards and away from the container. The form roll is biased for axial movement along an axis parallel to the container axis. The form roll deforming nose includes first and second oppositely inclined conical surfaces which are respectively opposed to the conical surfaces on the second roll and slide roll.

The limiting means preferably includes a stop spacer means which is fixedly mounted to a tooling spindle housing supporting the first and second rolls. The spacer means includes a stop surface in axial alignment with a rearward facing movable annular surface of the slide roll assembly. Without the spacer means, the slide roll assembly is normally free to move (against resilient bias) in the axially rearward direction towards the spindle housing as a result of camming engagement with the cam controlled, radially and axially movable outer form roll, without "bottoming out" of the slide roll assembly against the spindle housing. However, with the spacer means of the present invention, the stop surface contacts the slide roll assembly to prevent further axial retracting movement thereof before the cam controlled outer form roll has otherwise completed its radially inward movement as a result of cam follower action. Stopping of the slide roll assembly in this unique manner prevents further radially inward advancing movement of the outer form roll which advantageously results in substantially uniform plug diameters in successively necked cans.

The spacer means of the present invention is preferably used in combination with the cam ring improvement mounted to the slide roll radially outwardly adjacent therefrom.

A method of spin flow necking-in an open end of the cylindrical container body is also disclosed. The method comprises the steps of positioning inside the container body an axially fixed roll engageable with the inside surface of the container body. The axially fixed roll has a sloped end surface which faces the open end of the container body. A slide roll is also positioned inside the container body which fits the inside diameter of the open end to support same. The slide roll has an end which faces the sloped end surface of the axially fixed roll. The slide roll is supported for axially displacement away from the axially fixed roll. The slide roll end and the sloped end surface of the axially fixed roll define a gap therebetween. An outer form roll is positioned opposite the gap radially outwardly from the container body for axial displacement away from the axially fixed roll during contact with the sloped end of same. The form roll has a trailing end portion and a peripheral forming portion. As the container body spins, the form roll is advanced radially inwardly relative to the gap so that the trailing end portion presented by the roll and the sloped end surface of the axially fixed roll engage the container body between them while a trailing end portion of the form roll moves inwardly along the sloped end surface of the axially fixed roll to roll a neck into the container body. As the body continues to spin while the form roll moves inwardly, the slide roll is retracted axially until the roller has spun an outwardly extending portion on the end portion of the container body engaged between the slide roll and the container. In accordance with the method of the invention, the final axial retracting movement of the slide roll is controlled by having the slide roll contact a spacer fixedly mounted axially rearwardly of the slide roll. Such limiting contact prevents further radially inward advancing movement of the outer form roll by overriding the cam follower movement of the outer form roll. This in turn produces substantially uniform plug diameters in the necked-in containers.

In accordance with a further feature of the invention, the axial retracting movement of the slide roll, prior to contacting the spacer, is controlled by contact between a surface of the form roll with a cam follower surface. More specifically, the form roll has conical surfaces which are respectively engageable with the sloped end surface of the axially fixed roll and another sloped end surface on the slide roll. These form roll conical surfaces are smoothly connected with a curved forming surface extending therebetween and defined by a pair of small radii. The sloped end of the slide roll is also smoothly connected through another small radius to the axially extending surface thereof which is engageable with the inside surface of the container body. The cam follower surface operates to axially retract the slide roll as the small radius on the form roll approaches the small radius on the slide roll to thereby prevent pinching of the container side wall between these two small radii by allowing the radii to approach each other while maintaining separation therebetween by a distance slightly greater than the original thickness of the container side wall. Continued radially inward forming movement past a predetermined point at which the metal of the container side wall between the slide roll and the conical surface of the form roll has thickened will result in the form roll putting slight pressure directly on the metal. A gap opens between the form roll and cam follower surface so that the form roll is now pushing the slide roll directly through contact with the metal and not through contact with the cam follower surface. As the outermost end of the container side wall moves between the form roll and the slide roll, the form roll will once again contact the cam follower surface so that the rolling contact between the form roll and the slide roll does not excessively thin the edge of the open end. As this occurs, the slide roll will contact the spacer means and thereby be prevented from further axial retracting movement. The conical interconnection through the cam follower surface thereby prevents further radially inward movement of the form roll.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BEST MODE FOR CARRYING OUT INVENTION

Figure 3A:
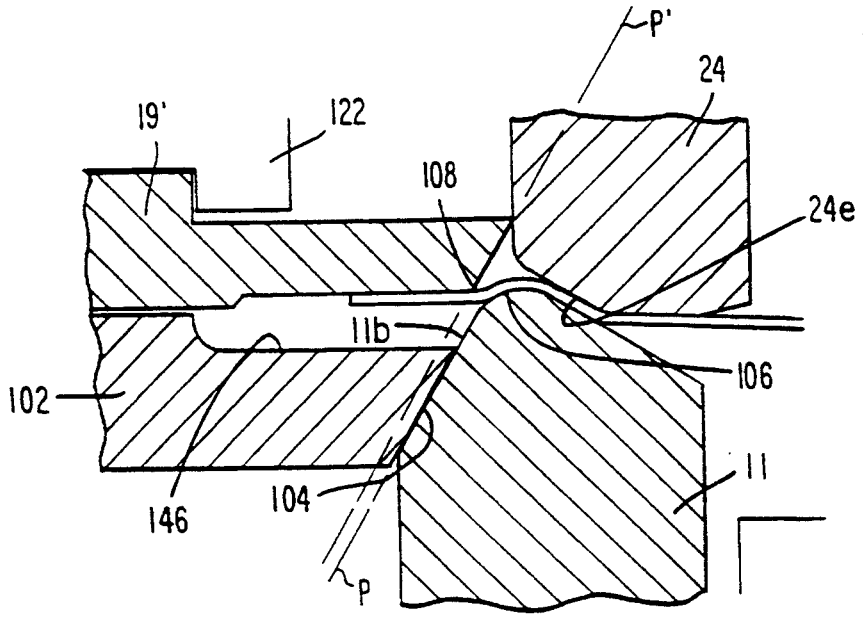
FIGS. 3A–3E are enlarged, detailed sequential views depicting the relative locations of the tooling components during necking with the cam ring improvement.
Figure 3B:
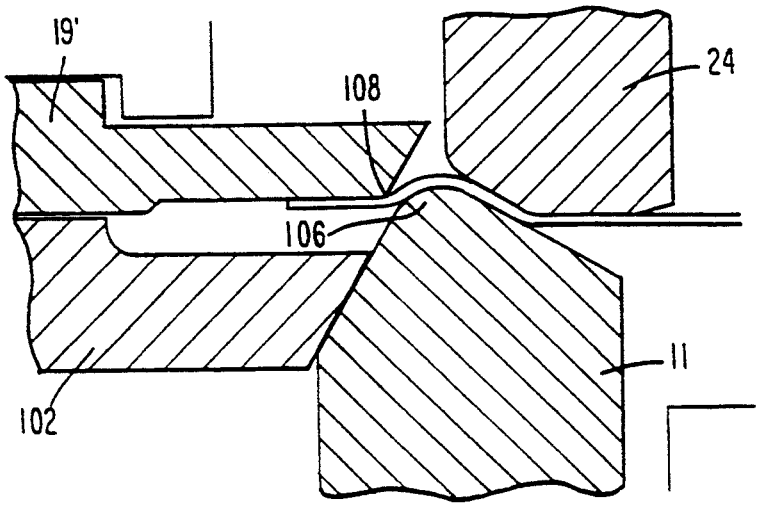
Figure 3C:
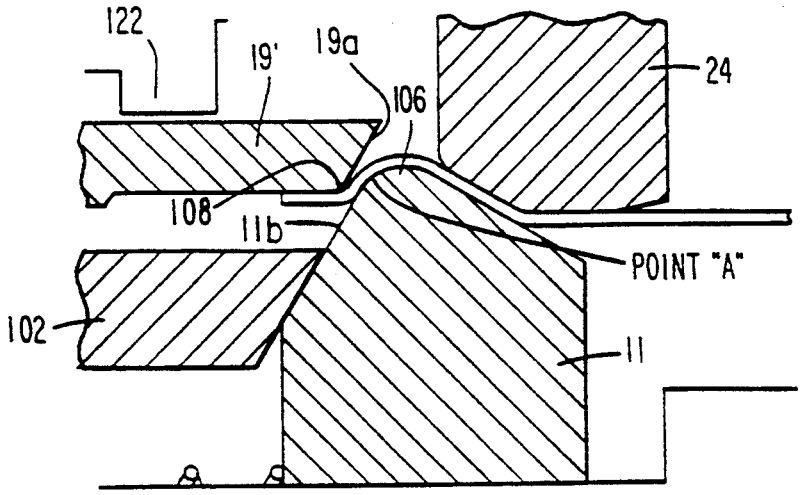
Figure 3D:
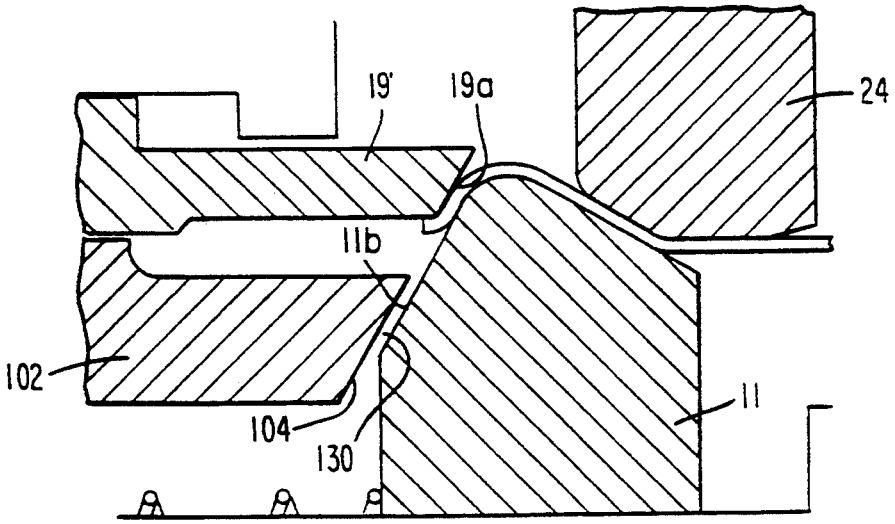
Figure 3E:
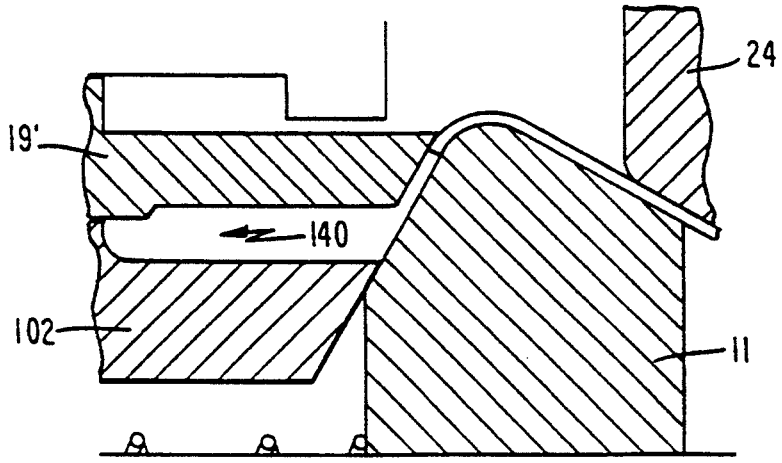
Figure 4A:
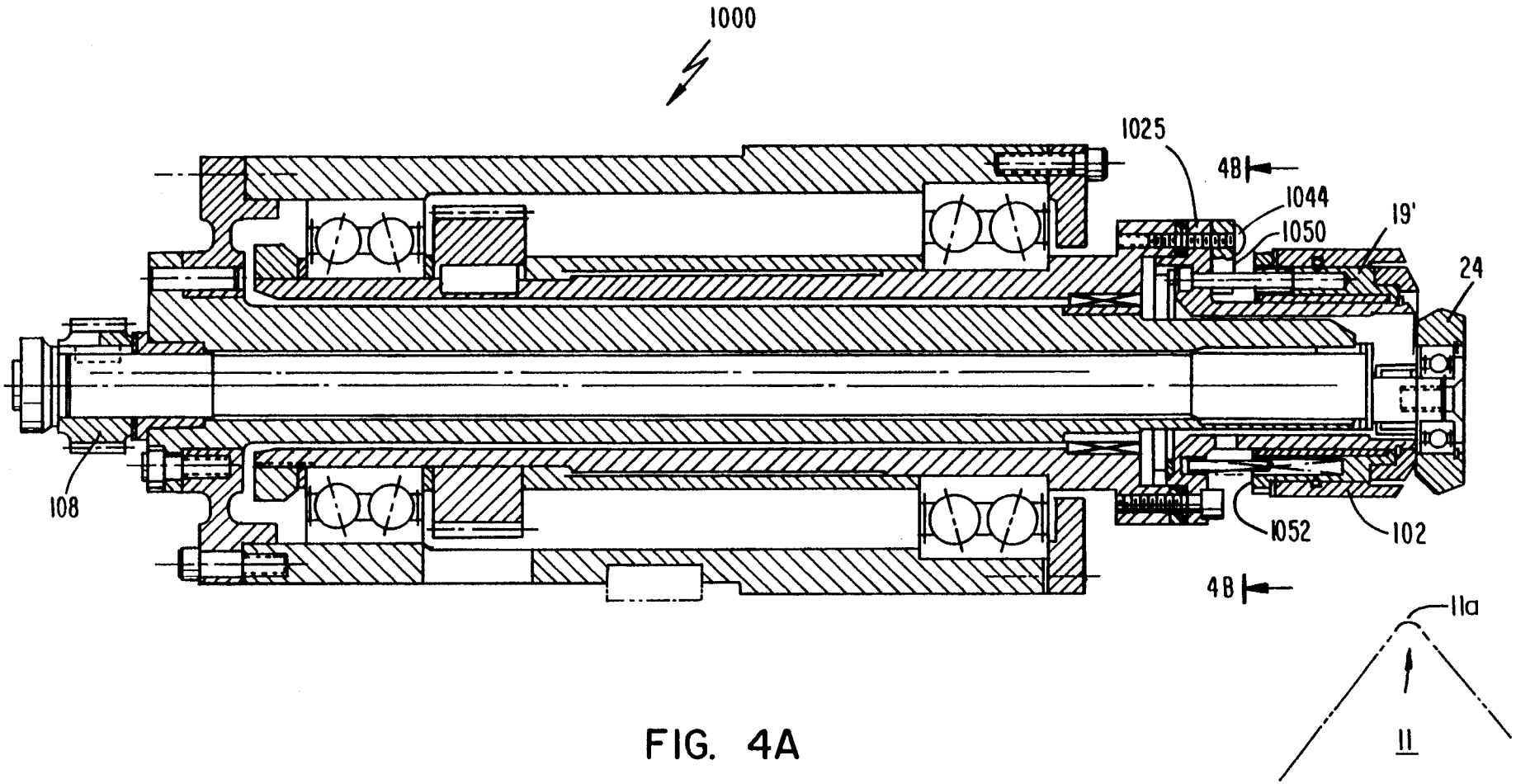
FIG. 4A is a cross-sectional illustration of a tooling necking spindle assembly in accordance with the present invention.
Figure 4B:
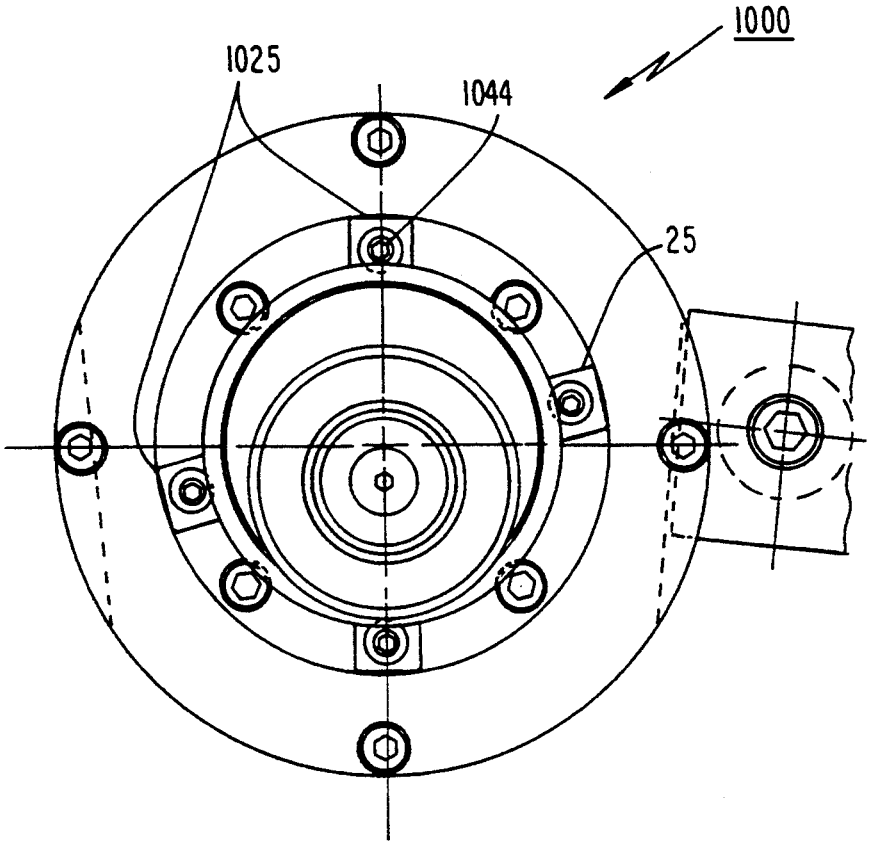
FIG. 4B is a sectional view taken along the line 4B—4B of FIG. 4A.

FIGS. 4A and 4B are sectional view illustrations of a spin flow necking assembly 1000 in accordance with the present invention. Therein, the functional components are substantially identical to the tooling components described in connection with FIG. 1, supra, and in connection with FIGS. 3A–3E, supra, except as noted hereinbelow.

Figure 5:
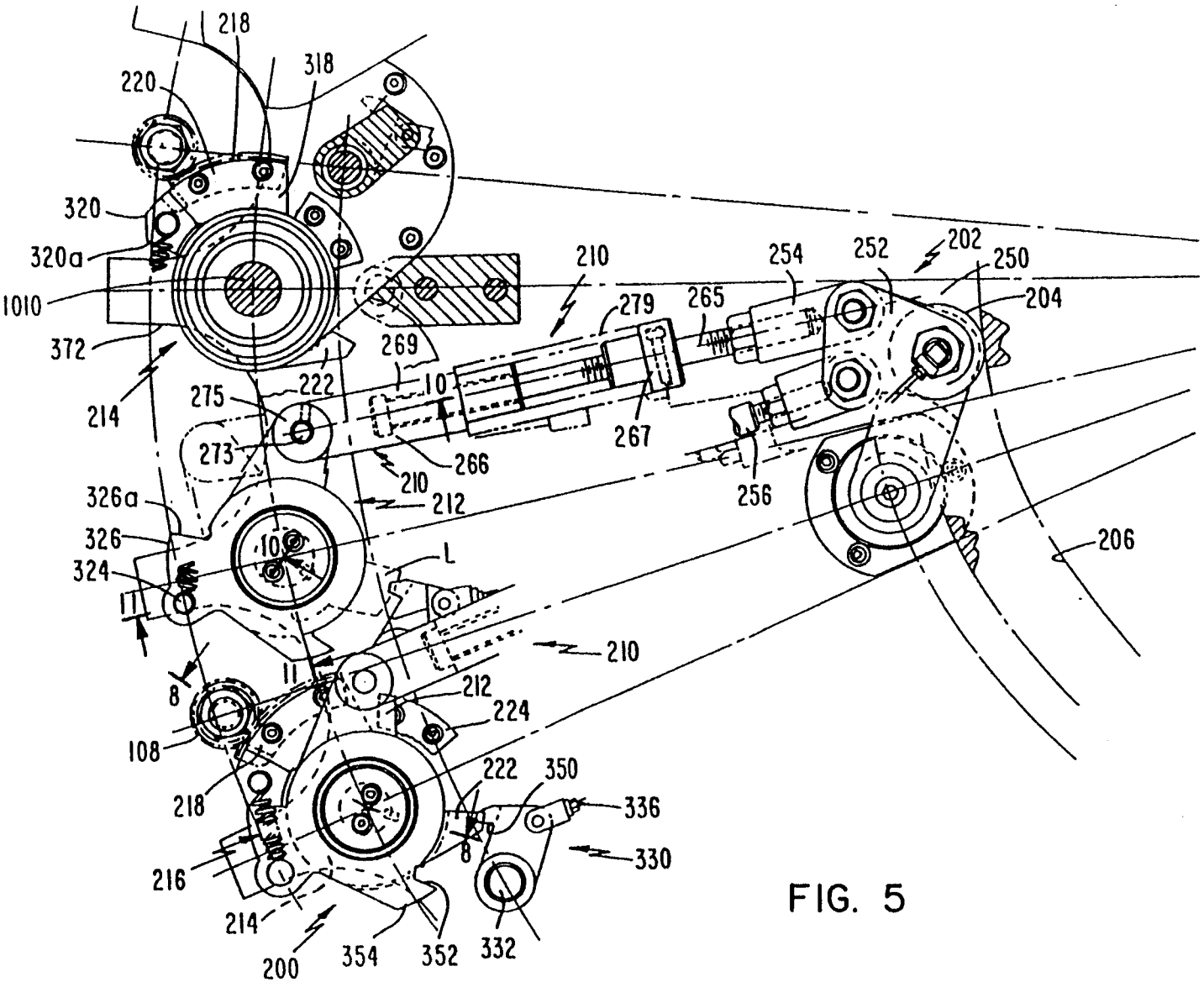
FIG. 5 corresponds to FIG. 7 of applicant's co-pending '932 application to depict cam controlled linkage and tool activation assemblies for controlling radial movement of the outer form rolls in a spin flow necking machine.

Furthermore, the spin flow necking assembly 1000 of FIG. 4A is adapted to be used as one of plural spin flow necking cartridges which may be mounted as known in the art to a main necking turret of a spin flow necking machine in respective coaxial alignment with base pad assemblies mounted to a base pad turret of such a machine. An exemplary embodiment of such a machine is depicted in FIG. 1A of our aforesaid copending application Ser. No. 929,932 (hereinafter "the '932 application"), incorporated herein by reference. Except as noted hereinbelow, the tooling assembly 1000 of FIG. 4A functions in a manner identical to the tooling assembly of FIG. 5 (incorporated herein by reference) disclosed in our '932 application. Briefly, the eccentric roll 24 is rotated from its eccentric solid line position depicted in FIG. 4A in supporting contact with the can open end into a radially inward clearance position (not shown) via rotation of the pinion 108 through a plurality of tooling activation assemblies 200 mounted to the rear face of the tooling disc turret. FIG. 5 herein corresponds to FIG. 7 (the written disclosure of which is incorporated by reference herein) of our co-pending '932 application. Therein, it can be seen that rotation of pinion 108 as well as radial movement of form roll or roller 11 (supported by shaft 1010) is controlled through a series of radially extending linkage arrangements 210 respectively interconnecting each tooling activation assembly 200 to a cam follower 204 in rolling contact with a cam surface 206 of a cam ring which is stationarily mounted to a support frame supporting the tooling disc turret. Further relevant details of FIG. 5 will be discussed hereinbelow.

As discussed above, each necking spindle assembly 1000 depicted in FIG. 4A operates in the manner described supra with reference to FIGS. 3A–3E. However, in accordance with the present invention, the necking operation described in connection with FIG. 3E is affected through the interposition of a plurality of identical stop spacers 1025 which are bolted to the front end of the spindle mounting assembly with bolts 1044 located radially outwardly from the path of movement of the slide roll assembly 19. The spacers 1025 extend radially inwardly from mounting screws 1044 to define a series of equispaced stop surfaces 1050 which are coplanar to each other and intersect and intersect a region into which the rear facing shoulder 1052 of the slide roll 19' axially moves.

With the stop spacers 1025 of FIG. 4A, as the form roll 11 is moved towards it radially innermost position of FIG. 3E under the action of cam follower 204 of FIG. 5 which rotates shaft 1010 through activation plate 275, the rear surface 1052 of the slide roll 19' contacts the stop surface 1050 of spacers 1025 which prevents further axial retraction of the slide roll assembly. This in turn prevents or "freezes" final radial movement of form roll 11 which would otherwise occur solely as a result of contact between cam follower 204 with cam surface 206. In this manner, the final radial positioning of outer form roll 11 is always controlled by the contact between the slide roll 19' with the spacers 1025 which axially "locks" the slide roll to override final radially inward camming movement of the outer form roll 11. Therefore, since the final radially inwardmost location of forming surface 11*a* of form roll 11 is now controlled by the stop spacer arrangement 1025 described supra, the resulting plug diameter formed by this surface 11*a* is substantially uniform. Stated differently, as the form roll 11 is forced into the gap between the eccentric roll 24 and the slide roll 19, the slide roll is forced away from the eccentric roll as discussed in connection with FIGS. 3A–3D. When the slide roll assembly 19 hits the stop spacers 1025, movement of the slide roll is halted. This in turn stops further inward radial travel of form roll 11. The eccentric roll 24 is axially rigid so when the slide roll 19 hits the stop surface 1050, the gap cannot get any wider. Therefore, the form roll 11 must stop.

Figure 1:
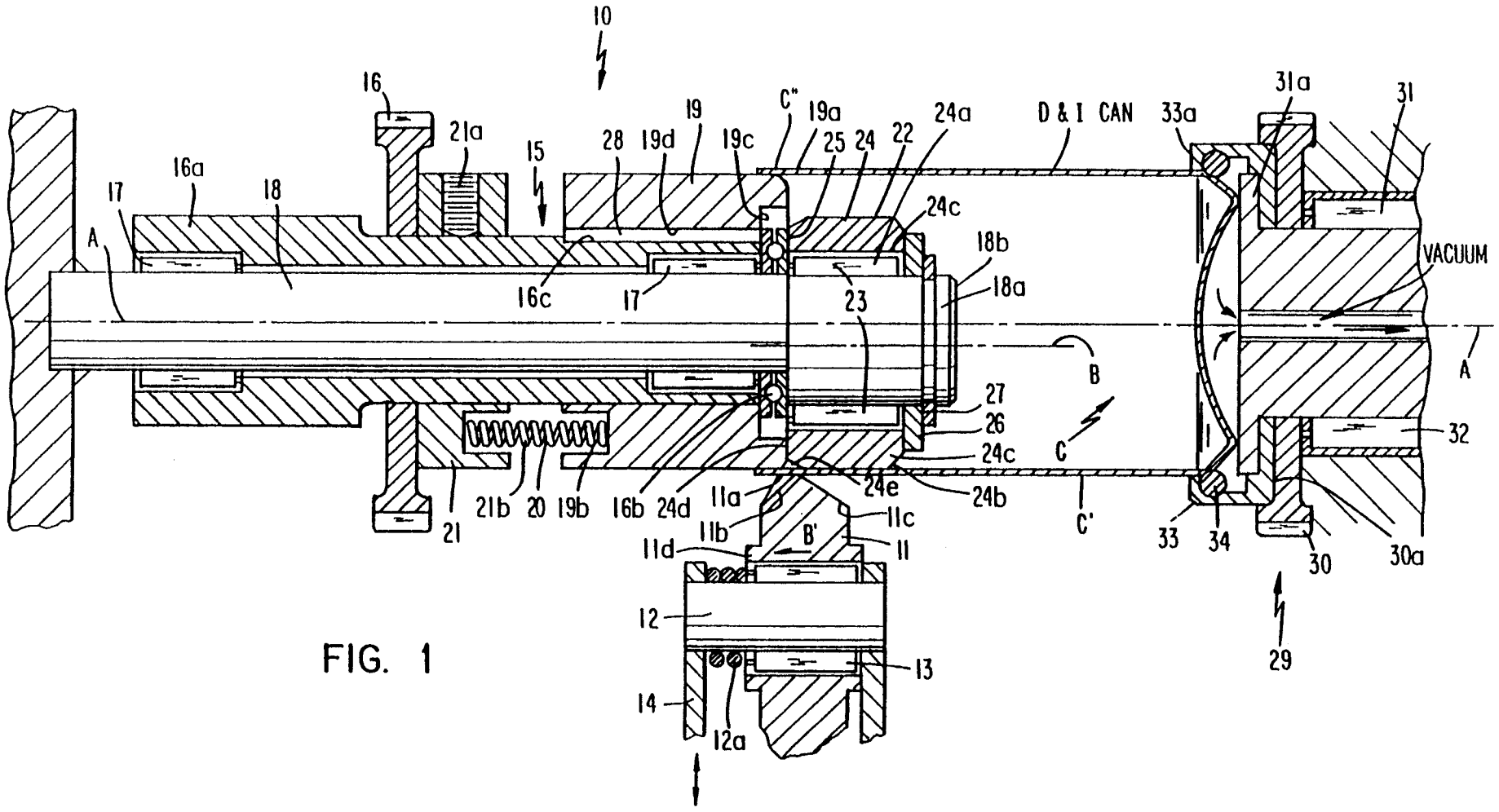
FIG. 1 is a cross-sectional view of a prior spin flow necking process.
Figure 2A:
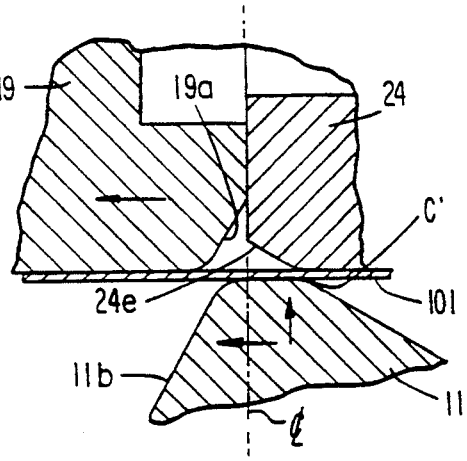
FIGS. 2A–2E are enlarged, cross-sectional sequential views depicting the spin flow necking forming sequence with the tooling of FIG. 1.
Figure 2B:
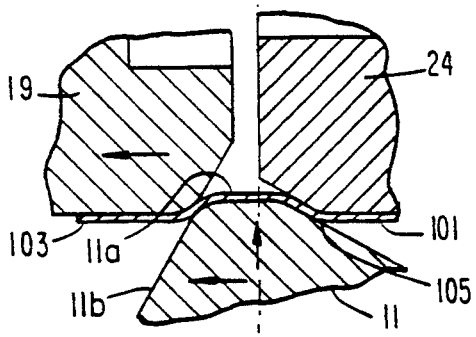
Figure 2C:
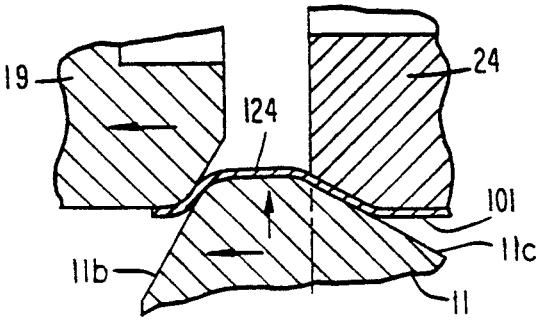
Figure 2D:
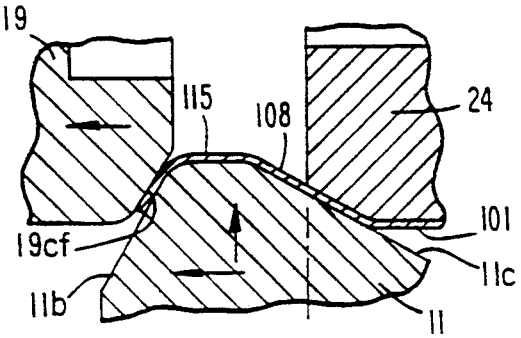
Figure 2E:
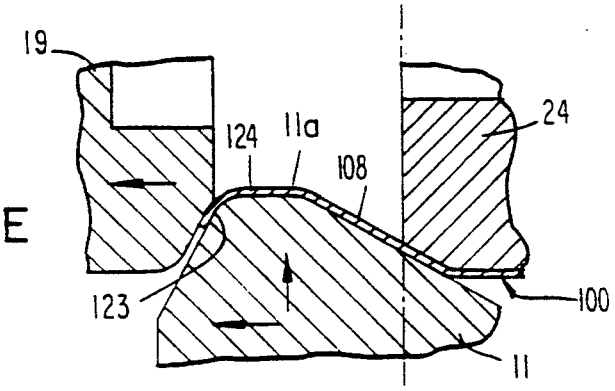

Although it is theoretically possible to stop the movement of the slide roll 19 in the necking tooling of the FIG. 1 embodiment (no cam ring) by placement of a spacer attached to collar 21 to contact the rear shoulder of slide roll 19, this is very difficult in practice. This is because when the form roll 11 forces the slide roll 19' against the stop surface 1025 in FIG. 4A, the force of the form roll that is moving the slide roll toward the stop acts through the cam ring and not through the can flange itself which would otherwise occur without the cam ring. The force required to actually form the can is approximately 80–100 pounds and the override spring 279 (FIG. 5) located on the side of the necking turret is pre-loaded to about 200–250 pounds. Since the cam follower movement transmitted through this spring 279 from cam follower 204 (FIG. 5) to the form roll 11 is a part of the mechanism which controls radial movement of the form roll, when the slide roll stops the form roll, it overrides this spring and the force of the form roll therefore builds from 80–100 pounds up to 200–250 pounds. This extra force must be supported by the cam ring on one side of the form roll and the eccentric roll and the can neck on the other side of the form roll. Therefore, if the cam ring is not used, the force required to stop the form roll must come from the slide roll face through the can flange to the form roll as in FIG. 1. This force on such a narrow can flange would be enough to roll the flange to a thin knife edge which unacceptably causes split flanges and uneven flange width.

The override spring 269 in the cam follower actuating linkage depicted in FIG. 5 was initially designed to perform an override function upon latch-out of the form roll activation plate 275 to prevent metal-to--metal contact between the form roll 11 and the holder and eccentric rolls 19,24 in the absence of can bodies, by preventing the form roll from traveling into its final radial cam controlled position into contact with these inner rolls, by allowing the spring loaded screw head 266 of the connecting screw in FIG. 5 to lift from its seated position to the lifted position depicted in FIG. 5. This override spring 269 now performs the additional function of allowing the linkage length of the connecting linkage arrangement 210 of FIG. 5 to adjust so that the spring 269 is compressed approximately 0.006" which provides bias to ensure that the form roll 11 moves to the same radially inwardmost position each time to maintain a consistent can plug diameter when the slide roll 19 contacts the stop spacers 1025. This pre-set compression of about 0.006" occurs when there is no can in the forming station. When a can is in the forming station, the spring is overridden more than the 0.006" because of the can metal thickness.

By limiting the inward travel of form roll 11, it is possible to maintain the plug diameter of the can open end within much closer limits than would occur without the stop spacer arrangement 1025. This is because the stop spacers 1025 limit the travel of the slide roll 19 to a specific dimension which produces a specific plug diameter. Once this specific dimension of travel is known, the tooling can be preset in the tool room to produce a can of specific plug diameter, by appropriate selection of stop spacer thickness which may be ground to a requisite thickness. Pre-setting the necking tooling in this manner in the tool room advantageously eliminates tedious adjustment of each station (e.g., thirty stations) on the spin flow necking machine.

Furthermore, since the plug diameter is now controlled by the slide roll travel, any adjustment to the base pad 29 (e.g., in FIG. 1) will mostly affect the flange width. Therefore, this means that the flange width can now be adjusted independently from the plug diameter by moving the base pad towards or away from the necking tooling to control the flange width. This greatly simplifies the operation of the spin flow necking machine in a can plant environment.

Figure 6:
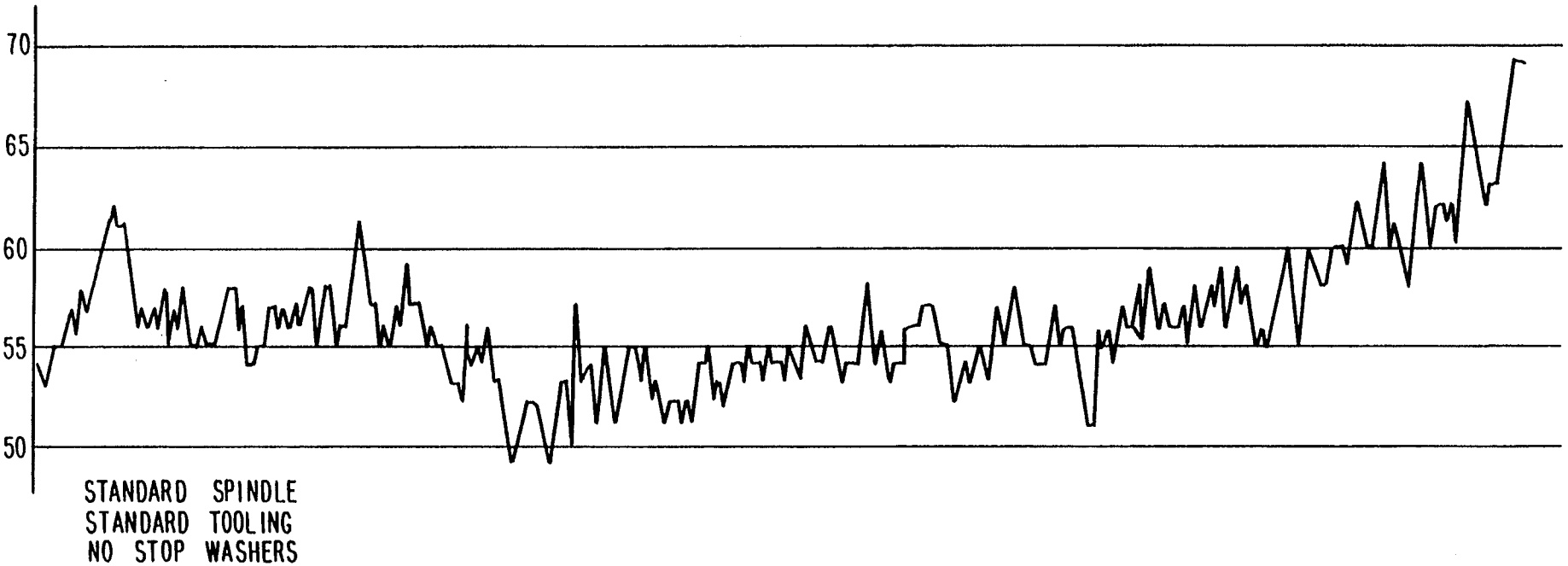
FIGS. 6–13 are graphical comparative representations of test results to illustrate plug diameter variations with and without the present invention.

FIG. 6 is a graph depicting the variation in plug diameter which occurs during consecutive can runs when using the necking tooling of FIG. 4A without the stop spacers 1025 of the present invention. Therein, it can be seen that there exists considerable variation in the can plug diameter when employing the tooling of FIG. 4A without the stop spacers.

Figure 7:
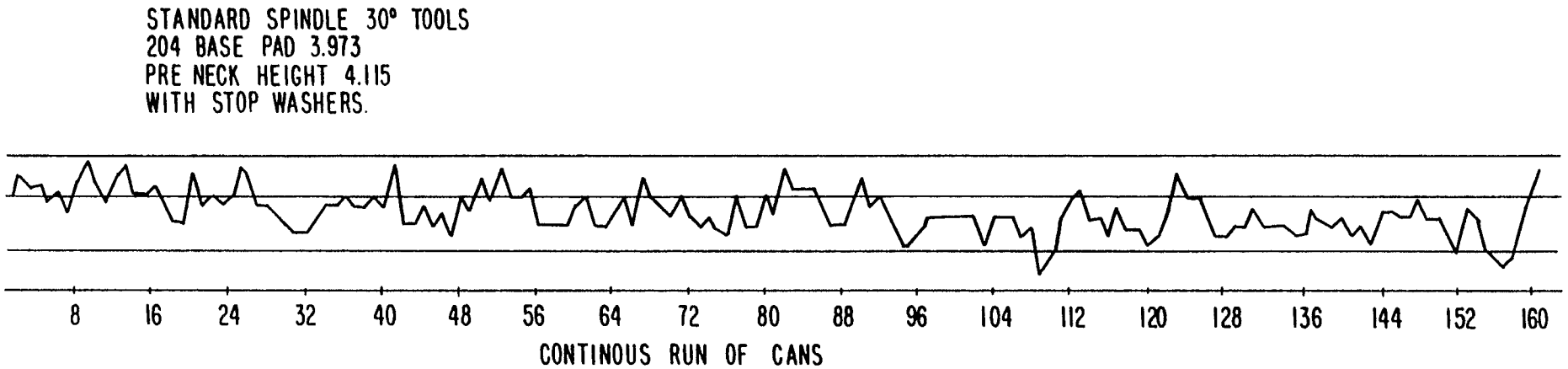

FIG. 7 is a graph of plug diameter during a continuous run of one hundred and sixty one cans, in the order of running, utilizing the tooling assembly of FIG. 4 with the stop spacer arrangement 1025 of the instant invention. By comparison of the test results between FIGS. 6 and 7, it is clear that the stop spacer arrangement 1025 of the instant invention results in more consistent, substantially uniform plug diameters versus that achieved without the stop spacer arrangement.

Figure 8:
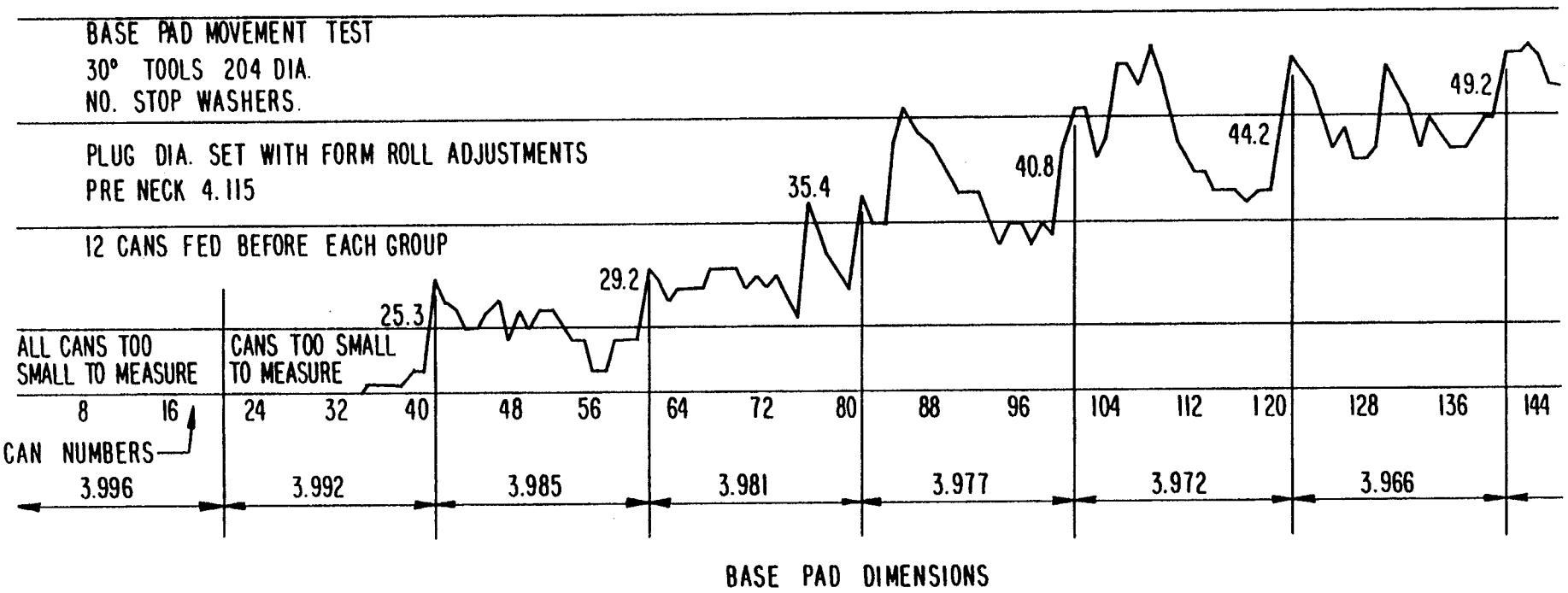

The continuous runs depicted in FIGS. 6 and 7 each occurred with a single base pad setting of approximately 3.973". FIG. 8 is a graph depicting the manner in which the plug diameter varies utilizing different base pad settings and the necking tooling of the FIG. 4A without the stop spacer arrangement 1025 of the instant invention. At each setting, approximately 12 cans were fed in before the 20 numbered cans depicted in FIG. 8 were run. Without the stop spacers 1025, when the can is positioned closer to the tooling, i.e., the open end of the can has slid further onto the slide roll, the flange width is increased almost directly by the amount the can is moved forward. The plug diameter is also larger because of the higher forces required to form the can with a wider flange. The results depicted in FIG. 8 show that the plug diameter tends to increase by approximately 80% of the amount the can is moved forward. For example, if the base pad is moved forward by about 0.010" and a can is formed with the necking tooling of FIG. 4A without the stop spacers 1025 of the present invention, its flange width would be about 0.010" wider and the plug diameter would be about 0.008" larger than a can formed at the original setting. In FIG. 8, the tooling of FIG. 4A (but without the stop spacers) was set to make a can with a small flange and plug and the base pad 29 was moved forward toward the tooling in approximately 0.005" increments. At the first base pad setting of 3.996", the cans produced had plug diameters which were smaller than could be measured with a plug gauge. At the next setting of 3.992" only a few cans could be measured which had a plug diameter of about 2.125–1.126". The next setting of 3.985" produced cans within the range of measurement. Thereafter, as the base pad setting decreased, all plug diameters were measurable.

From the graph of FIG. 8, it can be seen that as the base pad is moved toward the tooling, the average plug diameter increases by about 80% of the base pad movement, i.e., without the stop spacer arrangement 1025 of the present invention. Second, the variation in plug diameter within each test, i.e., at successively lower base pad settings, is higher than in comparable tests using stop spacer arrangements as depicted in FIG. 9 which is a test conducted in a similar manner to the test of FIG. 8 but with stop spacers.

Figure 9:
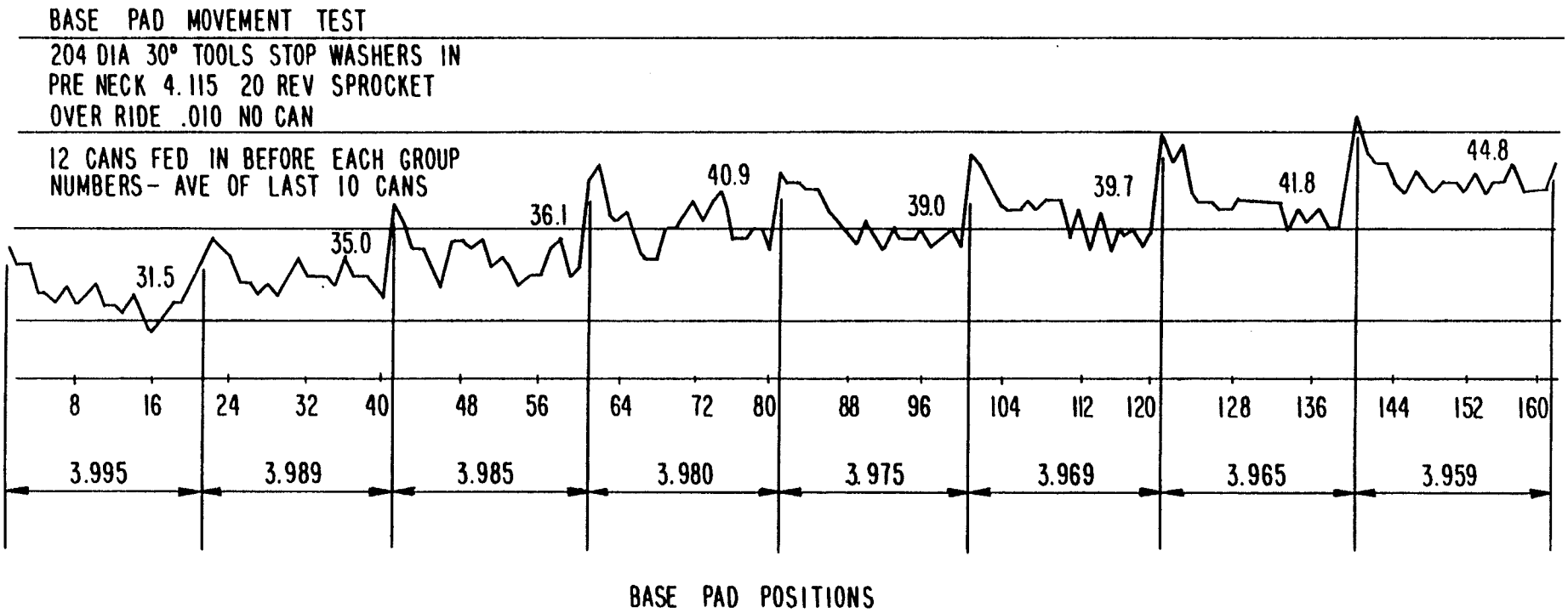

From a comparison of FIGS. 8 and 9, it is obvious that the individual can plug diameters are more uniform within a single group. Further, it is also obvious that the average plug diameter is less affected by a change in base pad settings.

Figure 10:
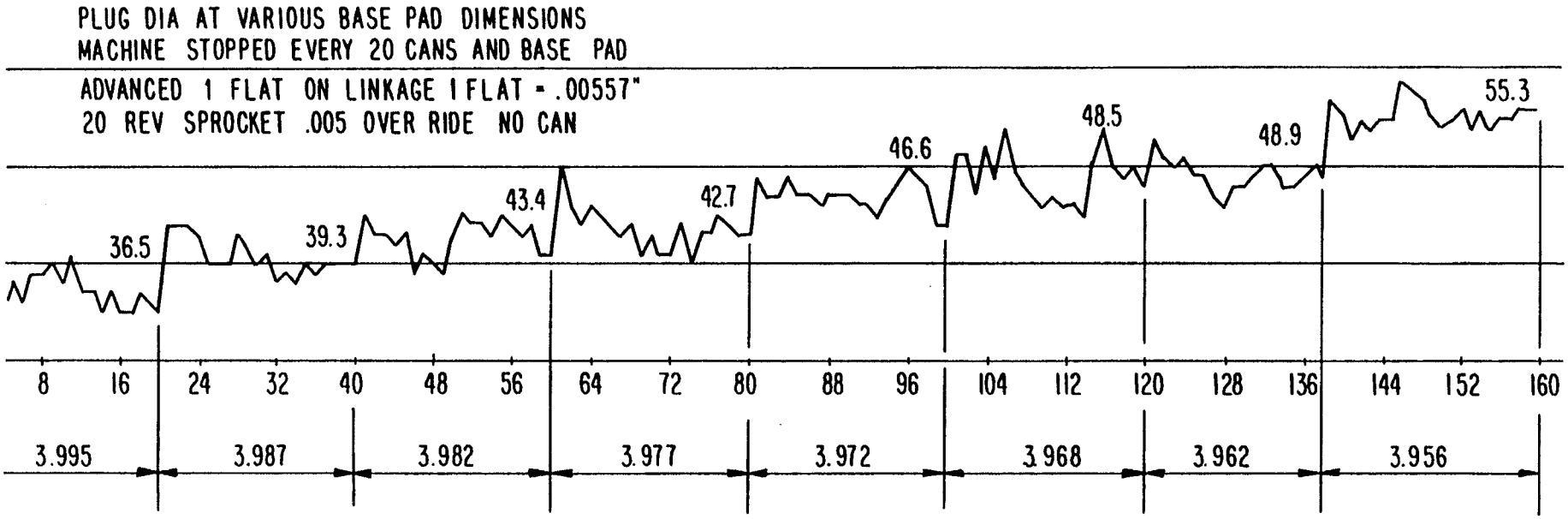
Figure 11:
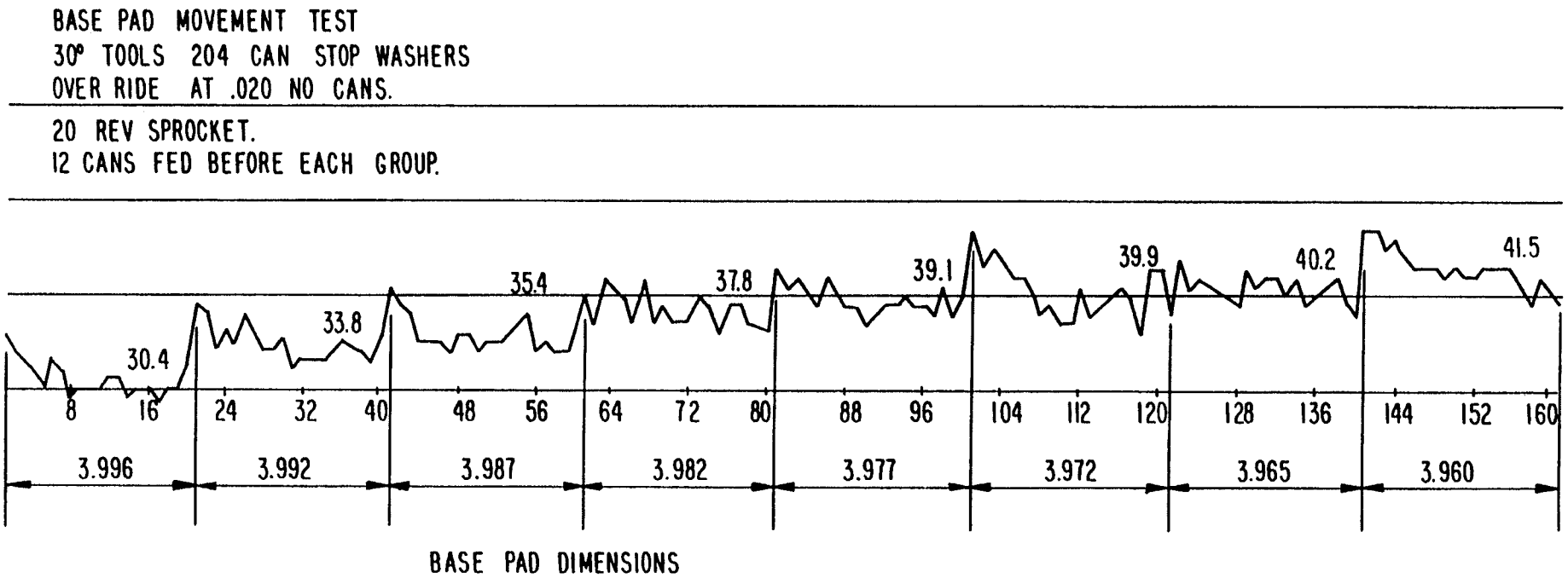
Figure 12:
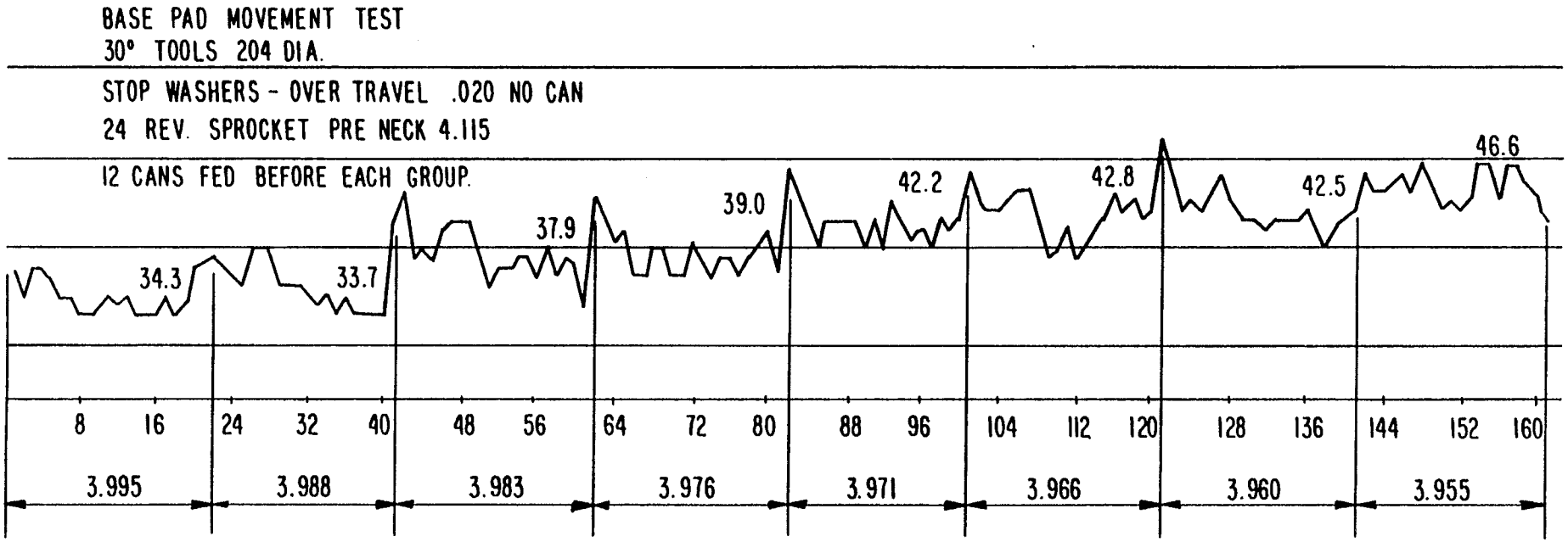

FIGS. 10–12 depict further test results in a manner similar to that of FIG. 9, i.e., utilizing stop spacers 1025 of the invention, but with different overrides of cam spring 269 or different numbers of revolutions during forming. All of these tests depict the same trends as the test results depicted in FIG. 9.

From the foregoing test results, the slope of the test results in FIG. 8 (no stop spacers according to the invention) is about 38° which indicates that the plug diameter changes approximately 80% of the base pad position change, as discussed supra. However, the average slope of the other curves in FIGS. 9–12 is about 16° which means that the plug diameter changes only about 28% of the base pad position change. Thus, significant advantages are achieved with the FIG. 4A embodiment of the invention utilizing the stop spacers 1025 in a production environment where a multi-station (e.g., 30 station) machine is employed and it is necessary to maintain all plug diameters within about 0.015". The stop spacer arrangement 1025 of the instant invention results in considerably improved controllability in a large machine with multiple stations that previously required tedious and repeated adjustment of both the form roll and the base pad settings to maintain the plug diameter within acceptable limits.

Figure 13:
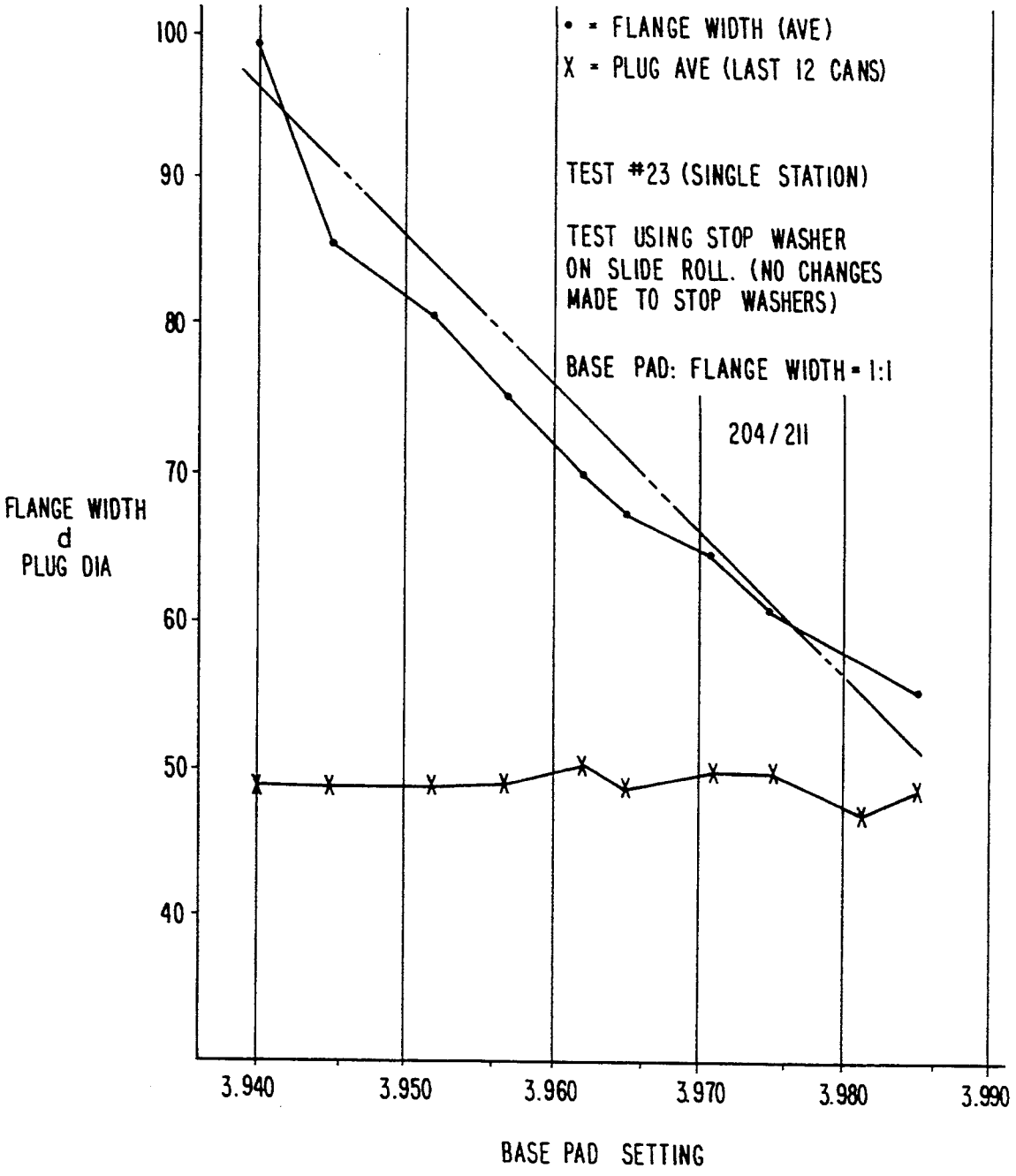

FIG. 13 is another graph depicting another run where the flange width and plug diameter were measured on each can and the average width and diameter were plotted against base pad position. This shows that the plug diameter changes little while the flange width changes directly as a function of base pad position.

In addition to the reference to the patent and copending applications hereinabove, reference is also made to a paper entitled "Spin-Flow Necking," by Harry W. Lee, Jr., C. Thomas Payne, Jr., Roger H. Donaldson, and Edward C. Miller. This paper is being presented on Sep. 30, 1992 in Chicago at the International Can Manufacturing Clinic of the Society of Manufacturing Engineers. Copies of the written paper are being made available on Sep. 29, 1992.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

I claim:

1. Apparatus for necking-in an open end of a side wall of a container body, comprising:

a) a first member and a second member mounted for engaging inside surfaces of the container side wall defining said open end;

b) an arrangement for rotating said container body;

c) an externally located member mounted for radially inward movement into deforming contact with an outside surface of said container side wall in a region thereof overlying an interface between said first and second members, whereby contact between said externally located member with said side wall causes the contacted wall portion to move radially inwardly into a gap formed at the interface caused by axial separation of said first and second members under the action of the radially inward advancing movement of the externally located member into the gap to thereby neck-in said side wall; and d) stop means for limiting axial movement of said first member to thereby stop the radially inward advancing movement of the externally located member.

2. Apparatus of claim 1, further comprising means, controlled by sensing radially inward movement of the externally located means, for initiating gradual axial separation of said first and second members before said externally located means acts directly on both said first and second members through the contacted portion.

3. Apparatus of claim 2, wherein said first member is a slide roll engaging the inside of the container side wall open end and mounted for driven rotary motion about, and axial movement along, the container axis, and including resilient means for biasing said slide roll into the container open end;

said second member is an axially fixed second roll mounted in axially inwardly spaced relation to the slide roll for engagement with an inside surface of the container side wall, said second roll having a conical end surface which faces the open end of the container and said slide roll including a conical end surface facing the conical end surface of the second roll, said conical surfaces extending in opposite inclinations to each other;

said externally located means is a form roll having a peripheral deforming nose positioned externally of the container side wall and mounted for free rotary and controlled radial movement towards and away from the side wall, said form roll being biased for axial movement along an axis parallel to the container axis, said form roll deforming nose including first and second oppositely inclined conical surfaces which are respectively opposed to the conical surface on the second roll and the conical surface on the slide roll.

4. Apparatus of claim 3, wherein said stop means includes a stop spacer axially fixedly mounted rearwardly of the slide roll to engage the slide roll during rearward axial movement thereof to thereby prevent further axial movement.

5. Apparatus of claim 1, further comprising means, controlled by sensing radially inward movement of the externally located means, for initiating gradual axial separation of said first and second members before said externally located means acts directly on both said first and second members through the contacted portion, wherein said stop means includes a stop spacer axially fixedly mounted rearwardly of the slide roll to engage the slide roll during rearward axial movement thereof to thereby prevent further axial movement.

6. A method of spin flow necking-in an open end of a cylindrical container body, comprising the steps of:

a) positioning inside the container body, in axial inwardly spaced relation from the open end thereof, an axially fixed roll engageable with an inside surface of the container body, said axially fixed roll having a sloped end surface which faces the open end;

b) positioning inside the container body a slide roll which fits the inside diameter of the container body to support the same, said slide roll having an end facing the sloped end surface of said axially fixed roll, and said slide roll being supported for axial displacement away from said axially fixed roll, said slide roll end and said sloped end surface of said axially fixed roll defining a gap therebetween;

c) positioning opposite said gap on an outside surface of the container body a form roll supported for axial displacement away from said axially fixed roll, said form roll having a trailing end portion and a peripheral portion;

d) spinning the container body thusly supported by said slide roll and advancing said form roll radially inwardly relative to said gap so that said trailing end portion presented by the form roll and said sloped end surface of said axially fixed roll engage the container body between them while said trailing end portion of said form roll moves radially inward along said sloped end surface of said axially fixed roll to roll a neck into the container body; and e) continuing to spin the container body while the form roll moves inwardly and the slide roll retracts axially until the form roll has spun an outwardly extending portion on the end portion of the container body engaged between said slide roll and said form roll; and f) stopping the radially inward movement of the form roll in step (e) by first preventing further axial retraction of the slide roll at a predetermined location.

7. The method of claim 6, wherein the axial retracting movement of the slide roll is controlled by contact between a surface of the form roll with a cam follower surface connected to the slide roll for controlling such axial retraction of said slide roll.

8. Apparatus for necking-in an open end of a side wall of a container body, comprising:

a) a necking spindle assembly for rotating said container body;

b) a slide roll and an eccentric roll mounted on said necking spindle assembly for engaging inside surfaces of the container side wall defining said open end;

c) a form roll mounted for radially inward movement into deforming contact with an outside surface of said container side wall in a region of the open end overlying an interface between said slide and eccentric rolls, whereby contact between said form roll with said side wall causes the contacted surface of said container side wall to move by radially inward deformation into a gap formed at the interface caused by axial separation of said slide and eccentric rolls under the action of the radially inward advancing movement of the form roll into the gap to thereby neck-in said side wall; and d) at least one stop spacer mounted to the necking spindle assembly rearwardly from and within a region into which a rear portion of the slide roll axially moves for limiting further axial retraction of said slide roll by contacting said rear portion to thereby stop the radially inward advancing movement of the form roll.

9. Apparatus of claim 8, further comprising a cam ring connected to the slide roll and including a cam follower surface which is contacted by the form roll during radially inward movement of the form roll to initiate gradual said axial separation between said slide and eccentric rolls before said form roll acts directly on both said slide and eccentric rolls through said contacted surface, said axial separation occurring as a result of form roll induced movement of said cam ring transmitted to impart rearward axial retraction of the slide roll.

10. Apparatus of claim 9, wherein said slide roll engages the inside of the container side wall open end and is mounted for driven rotary motion about, and axial movement along, the container axis, and including a spring for biasing said slide roll into the container open end;

said eccentric roll is axially fixed and mounted in axially forwardly spaced relation to the slide roll for engagement with an inside surface of the container side wall, said eccentric roll having a conical surface which faces the open end of the container and said slide roll including a conical surface facing the conical surface of the eccentric roll, said conical surfaces extending in opposite inclinations to each other;

said form roll having a peripheral deforming nose positioned externally of the container side wall and mounted for free rotary and controlled radial movement towards and away from the side wall, said form roll being biased for axial movement along an axis parallel to the container axis, said form roll deforming nose including first and second oppositely inclined conical surfaces which are respectively opposed to the conical surface on the eccentric roll and the conical surface on the slide roll.

11. Apparatus of claim 10, wherein said at least one stop spacer is axially fixedly mounted rearwardly of the slide roll to engage the slide roll during rearward axial movement thereof to thereby prevent further axial movement.

12. Apparatus of claim 8, further comprising a cam ring connected to the slide roll and including a cam follower surface which is contacted by the form roll during radially inward movement of the form roll to initiate gradual said axial separation between said slide and eccentric rolls before said form roll acts directly on both said slide and eccentric rolls through said contacted surface, said axial separation occurring as a result of form roll induced movement of said cam ring transmitted to impart rearward axial retraction of the slide roll, wherein said at least one stop spacer is axially fixedly mounted rearwardly of the slide roll to engage the slide roll during rearward axial movement thereof to thereby prevent further axial movement.

* * * * *